US005903096A

United States Patent [19]

Winsor

[11] Patent Number: 5,903,096

[45] Date of Patent: May 11, 1999

[54] PHOTOLUMINESCENT LAMP WITH ANGLED PINS ON INTERNAL CHANNEL WALLS

[75] Inventor: Mark D. Winsor, Seattle, Wash.

[73] Assignee: Winsor Corporation, Olympia, Wash.

[21] Appl. No.: 08/940,609

[22] Filed: Sep. 30, 1997

[51] Int. Cl.[6] ..... H01J 1/62

[52] U.S. Cl. ..... 313/493; 313/609; 313/610; 313/634

[58] Field of Search ..... 313/493, 609, 313/610, 611, 634, 483

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |
| 2,555,749 | 6/1951 | Krefft | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,103,607 | 9/1963 | Rulon | 313/108 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,313,652 | 4/1967 | Blazek et al. | 117/215 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |
| 4,482,580 | 11/1984 | Emmett et al. | 427/66 |
| 4,698,547 | 10/1987 | Grossman et al. | 313/485 |

FOREIGN PATENT DOCUMENTS

| | | | |
|---|---|---|---|
| 0 066 495 A2 | 12/1982 | European Pat. Off. | H01J 61/32 |
| 0 329 226 A1 | 8/1989 | European Pat. Off. | H01J 65/04 |
| 0 550 047 A2 | 7/1993 | European Pat. Off. | H01J 61/70 |
| 89 04 853 U | 8/1989 | Germany | H01J 61/67 |
| 39 22 865 A1 | 1/1991 | Germany | H01J 65/04 |
| 43 13 017 A1 | 12/1994 | Germany | H01J 61/70 |
| 60-216435 | 10/1985 | Japan . | |
| 62-208536 | 9/1987 | Japan . | |
| 1017374 | 1/1989 | Japan . | |
| 64-17374 | 1/1989 | Japan | H01J 61/30 |
| 1206553 | 8/1989 | Japan . | |
| 2-72552 | 3/1990 | Japan | H01J 61/30 |
| 2-78147 | 3/1990 | Japan | H01J 61/30 |
| 3-46748 | 2/1991 | Japan | H01J 61/94 |
| 3-129659 | 6/1991 | Japan | H01J 61/35 |
| 3-222253 | 10/1991 | Japan | H01J 61/92 |
| 3-285249 | 12/1991 | Japan | H01J 61/32 |
| 4-95337 | 3/1992 | Japan | H01J 61/67 |
| 4-147554 | 5/1992 | Japan | H01J 61/30 |
| 2 032 681 | 5/1980 | United Kingdom . | |
| 2 217 515 | 10/1989 | United Kingdom | H01J 61/30 |
| WO 87/04562 | 7/1987 | WIPO . | |
| WO 92/02947 | 2/1992 | WIPO | H01J 61/30 |

OTHER PUBLICATIONS

Mercer et al., "Fluorescent backlights for LCDs," *Information Display:* 8–13, Nov. 1989.

Hinotani et al., "Flat Fluorescent Lamp for LCD Back–Light," 1988 *International Display Research Conference.*

*Primary Examiner*—Vip Patel

*Attorney, Agent, or Firm*—Seed and Berry LLP

[57] ABSTRACT

A planar photoluminescent lamp having a plurality of internal walls to form a serpentine channel includes a deflection member at a distal end at least portion of the internal walls to force a plasma discharge into a central portion of the channel to thereby provide more uniform lighting at junctions between the turns in the serpentine channel. As a result, the photoluminescent lamp has more uniform brightness. The principles of the present invention may be extend to any photoluminescent lamp having a junction between two channels wherein a guide member serves to guide the plasma discharge toward the center of the channel at the junction.

(List continued on next page.)

18 Claims, 9 Drawing Sheets

U.S. PATENT DOCUMENTS

| | | | |
|---|---|---|---|
| 4,710,679 | 12/1987 | Budinger et al. | 315/58 |
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,803,399 | 2/1989 | Ogawa et al. | 313/493 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 |
| 4,916,352 | 4/1990 | Haim et al. | 313/25 |
| 4,916,356 | 4/1990 | Ahern et al. | 313/336 |
| 4,916,359 | 4/1990 | Jönsson | 313/489 |
| 4,920,298 | 4/1990 | Hinotani et al. | 313/493 |
| 4,924,143 | 5/1990 | Imamura et al. | 313/493 |
| 4,983,881 | 1/1991 | Eliasson et al. | 313/607 |
| 5,051,648 | 9/1991 | Misono et al. | 313/13 |
| 5,066,257 | 11/1991 | Farner et al. | 445/26 |
| 5,143,433 | 9/1992 | Farrell | 362/29 |
| 5,211,463 | 5/1993 | Kalmanash | 362/26 |
| 5,220,249 | 6/1993 | Tsukada | 315/246 |
| 5,237,641 | 8/1993 | Jacobson et al. | 385/146 |
| 5,253,151 | 10/1993 | Mepham et al. | 362/216 |
| 5,319,282 | 6/1994 | Wiinsor | 315/169.4 |
| 5,343,116 | 8/1994 | Winsor | 313/493 |
| 5,442,522 | 8/1995 | Kalmanash | 362/26 |
| 5,463,274 | 10/1995 | Winsor | 313/493 |
| 5,466,990 | 11/1995 | Winsor | 315/56 |
| 5,479,069 | 12/1995 | Winsor | 313/493 |
| 5,479,071 | 12/1995 | Lynn | 313/514 |
| 5,509,841 | 4/1996 | Winsor | 445/26 |
| 5,536,999 | 7/1996 | Winsor | 313/493 |
| 5,645,337 | 7/1997 | Gleckman | 362/29 |

PHOTOLUMINESCENT LAMP WITH ANGLED PINS ON INTERNAL CHANNEL WALLS

TECHNICAL FIELD

The present invention is related generally to planar photoluminescent lamps, and, more particularly, to planar photoluminescent lamps having a uniform light intensity.

BACKGROUND OF THE INVENTION

Planar fluorescent lamps are useful in many applications, including backlights for displays, such as liquid crystal. A common weakness in such fluorescent lamps is their lack of uniformity in light intensity across the entire planar lamp.

Some planar fluorescent lamps utilize a plasma discharge through a low pressure mercury vapor and buffer gas to produce ultraviolet energy. The ultraviolet energy excites a fluorescent material which converts the ultraviolet energy to visible light. To produce the low pressure plasma discharge, such lamps typically require a substantial minimum energy input. If the lamps are driven below the minimum energy input, the plasma discharge may not be formed, or may be highly non-uniform. Moreover, even with an energy input well above the minimum energy, the lamp may still be non-uniform in light intensity due to the lack of uniformity in the distribution of the plasma discharge.

As is known to those of ordinary skill in the art, the light intensity produced by the lamp is proportional to the electric current in the plasma discharge. If the plasma discharge is non-uniform, the light produced by the lamp will be non-uniform. Thus, it is desirable to produce a lamp with uniform current density in the plasma discharge. However, the conventional planar fluorescent lamp lacks such uniformity in the current density and thus lacks uniformity in light intensity.

Therefore, it can be appreciated that there is a significant need for a planar fluorescent lamp having a uniform light intensity. The present invention provides this, and other advantages, as will be apparent from the following description and accompanying figures.

SUMMARY OF THE INVENTION

The present invention is embodied in a gas-filled photoluminescent lamp containing a photoluminescent material to emit visible light when the gas emits ultraviolet energy in response to a plasma discharge. The lamp comprises a lamp housing having first and second interconnected passageways coupled together at a junction to form a channel with a channel length extending from a first end to a second end. A first electrode is associated with the lamp body in proximity with the first channel end and a second electrode, which is associated with the lamp body in proximity with the second channel end. The first and second electrodes are configured to produce the plasma discharge therebetween along the channel length when supplied with electrical power. The lamp also includes a guide member in proximity with the junction and extending into the channel to partially block the channel and thereby guide plasma discharge to a central portion of the channel.

In one embodiment, the guide member includes first and second angled fins extending from the junction into the channel. Alternatively, the guide members may include curved guide members.

In one embodiment, the first and second electrodes are a cold cathode type electrode. The first and second electrodes may be internal type cathodes mounted within the lamp body.

In one embodiment, the lamp housing may include first and second opposing endwalls and may further include a first internal wall extending from the first endwall and terminating a predetermined distance from the second endwall and a second internal channel wall extending from the second endwall and terminating a predetermined distance from the first endwall such that the lamp has a plurality of junctions formed at the terminating ends of the first and second channel walls. In this embodiment, the lamp includes a guide member associated with each of the plurality of junctions.

DETAILED DESCRIPTION OF THE INVENTION

The principles of operation of a fluorescent lamp are well known by those of ordinary skill in the art, and need not be described in detail herein. However, to better understand the nature of the present invention, a brief discussion of conventional fluorescent lamp technology, and its drawbacks, are presented below.

Figure 1A:
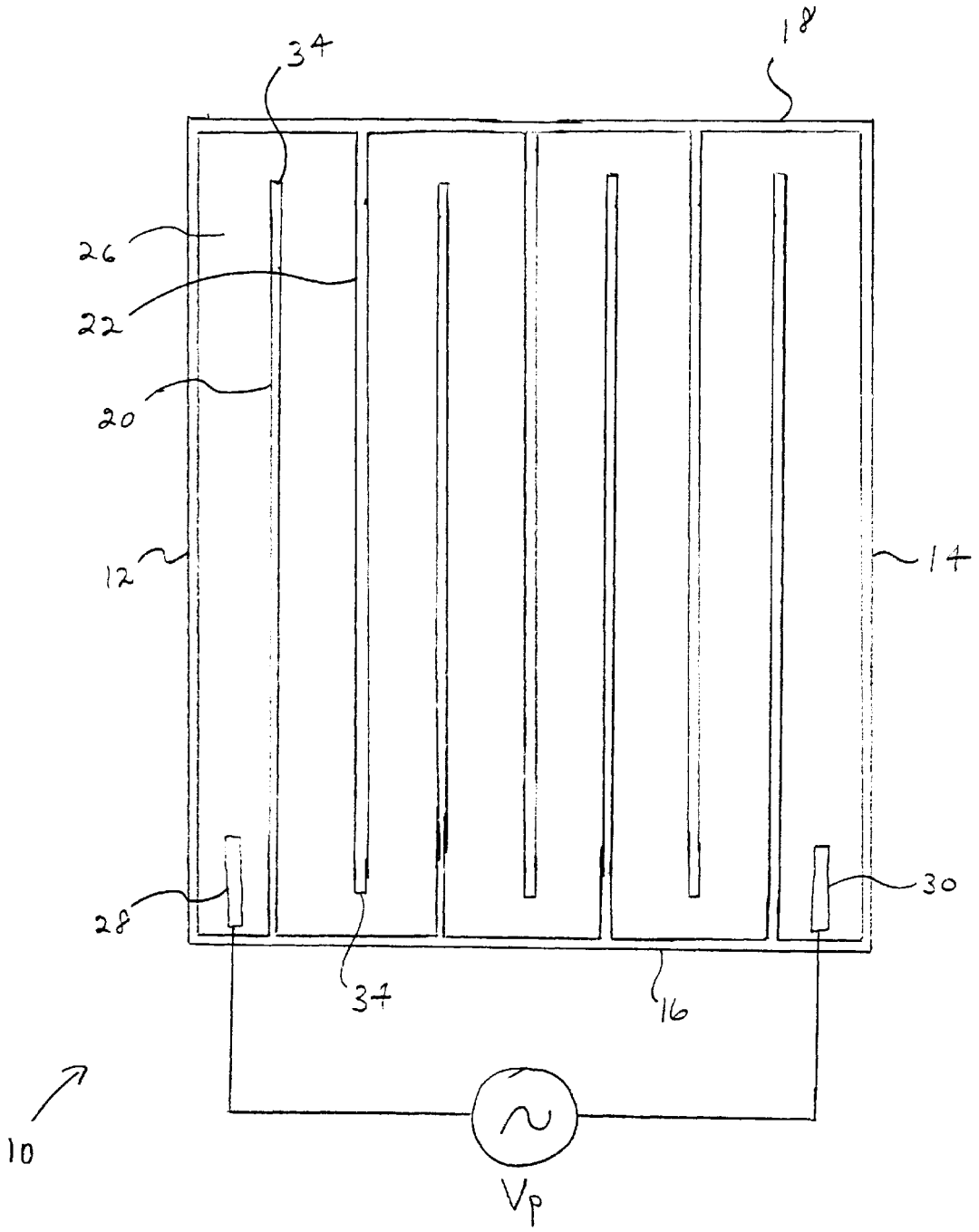
FIG. 1A (PRIOR ART)
FIG. 1A is a top plan view of a conventional lamp.

A conventional planar fluorescent lamp 10 is illustrated in FIG. 1A. The lamp 10 includes first and second opposing sidewalls 12 and 14, as well as a first and second opposing endwalls 16 and 18, respectively. Within the lamp 10 are a first plurality of internal sidewalls 20, which extend from the first endwall 16 toward the second endwall 18 and terminate a short distance from the second endwall. Similarly, a second plurality of internal sidewalls 22 extend from the second endwall 18 toward the first endwall 16 and terminate a short distance from the first endwall. The various sidewalls, endwalls, and internal sidewall serve to define a serpentine channel 26. The lamp 10 also includes a cover (not shown) which is sealed to the various sidewalls and endwalls to permit the formation of a vacuum within the serpentine channel 26.

The lamp 10 also includes first and second electrodes 28 and 30, which are illustrated in FIG. 1A as cold cathode internal electrodes. Electrical wires extending through the first endwall 16 permit the connection of the first and second cathodes to a power supply $V_p$. As is known in the art, the power supply $V_p$ typically provides a high-voltage alternating current applied to the first and second electrodes 28 and 30.

As is well known in the art, the sealed lamp is filled with a gas, which typically includes mercury vapor. When the power supply $V_p$ is applied to the first and second electrodes 28 and 30, a plasma discharge occurs between the first and second electrodes. The plasma discharge follows the serpentine channel 26 between the first and second electrodes 28 and 30.

Figure 1B:
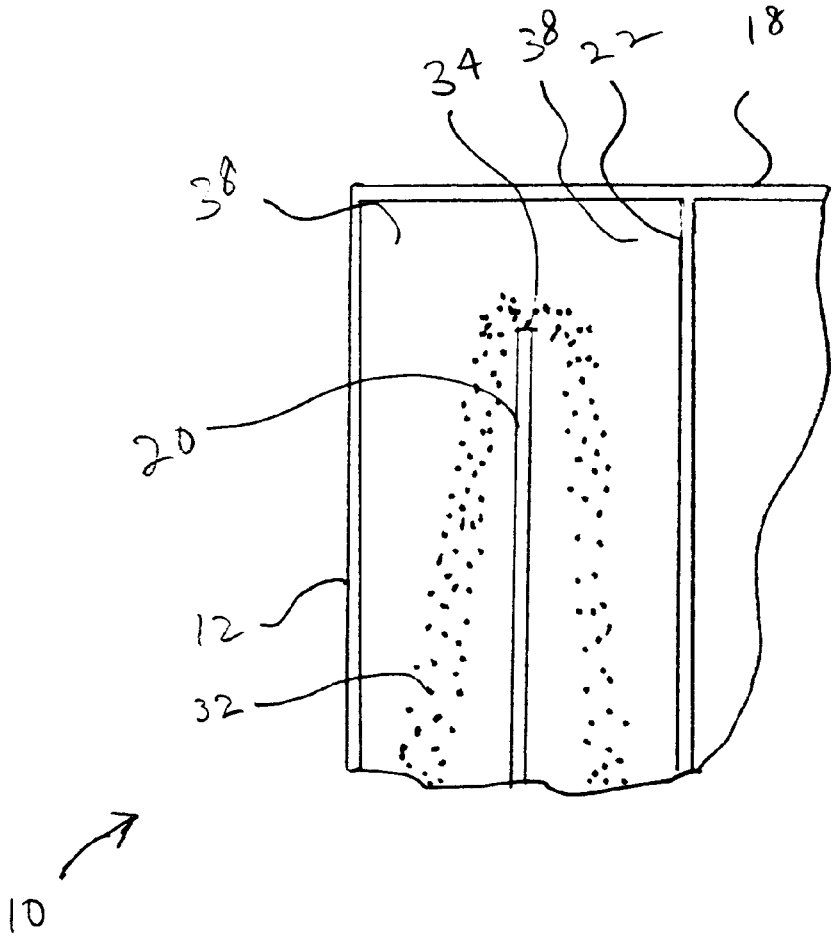
FIG. 1B (PRIOR ART)
FIG. 1B is an enlarged fragmentary view of the lamp of FIG. 1A.

However, the plasma discharge follows the path of least resistance (i.e., the shortest path) between the first and second electrodes 28 and 30. The effect of this path of least resistance is illustrated in FIG. 1B, which is an enlarged fragmentary view of the conventional lamp 10 of FIG. 1A. The plasma discharge pathway is illustrated in FIG. 1B by the reference numeral 32. Along most of the length of the serpentine channel 26, the plasma discharge pathway 32 is in substantially the center portion of the serpentine channel. However, near the terminating ends of each of the plurality of internal sidewalls 20 and 22, the plasma discharge pathway 32 travel in close proximity with a terminating portion 34 of the internal sidewalls 20 and 22. As a result, the current density is increased near the terminating portion 34 of the internal sidewalls 20 and 22, resulting in bright spots near the terminating portions. Furthermore, corners 38 of the serpentine channel 26 receive little or none of the current flowing in the plasma discharge. As a result, there is little or no light produced in the corners 38 of the serpentine channel 26 of the lamp 10. Thus, the lack of uniformity in the current density of the plasma discharge results in nonuniformity of light intensity in the lamp 10.

Figure 2A:
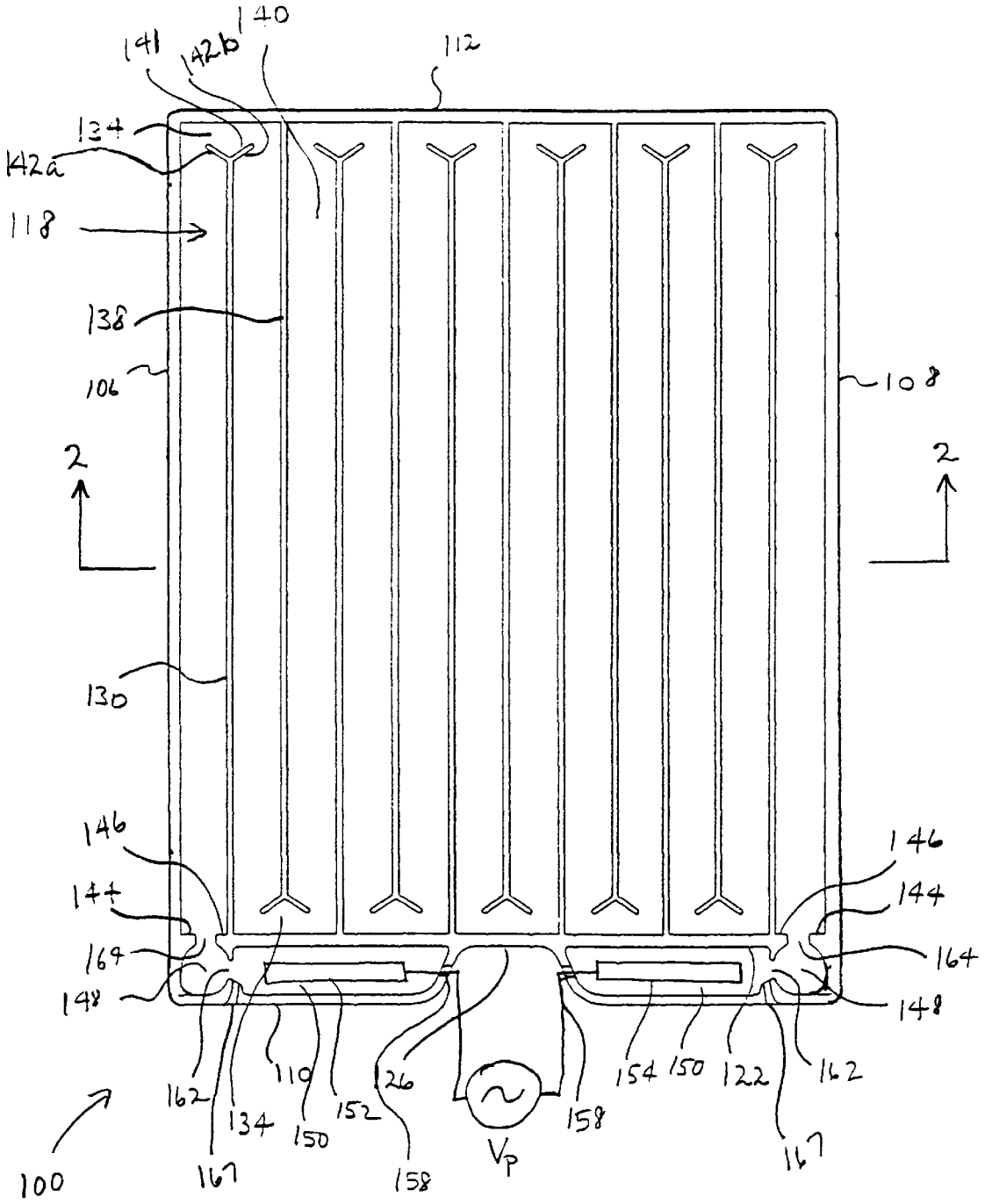
FIG. 2A is a top plan view of a lamp according to one embodiment of the present invention.
Figure 2B:
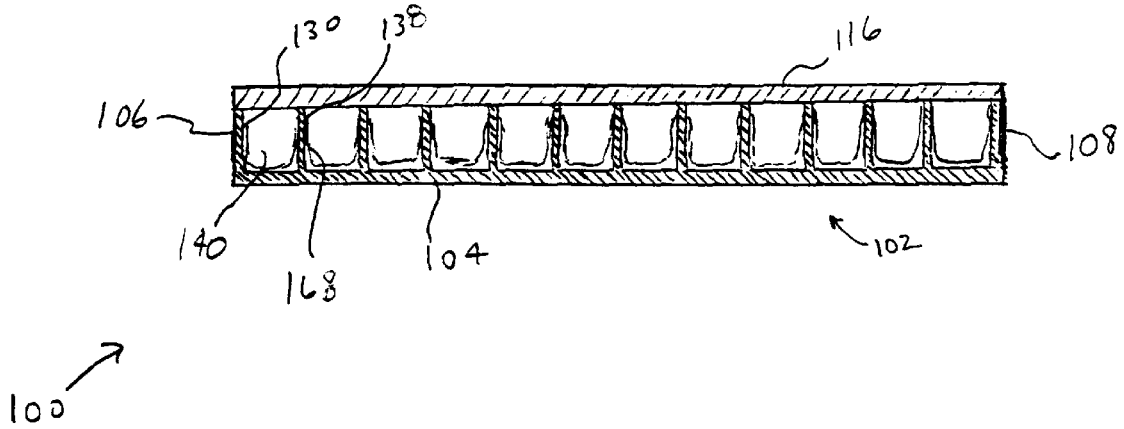
FIG. 2B is a side elevational view of the lamp of FIG. 2A taken along the line 2—2.
Figure 3:
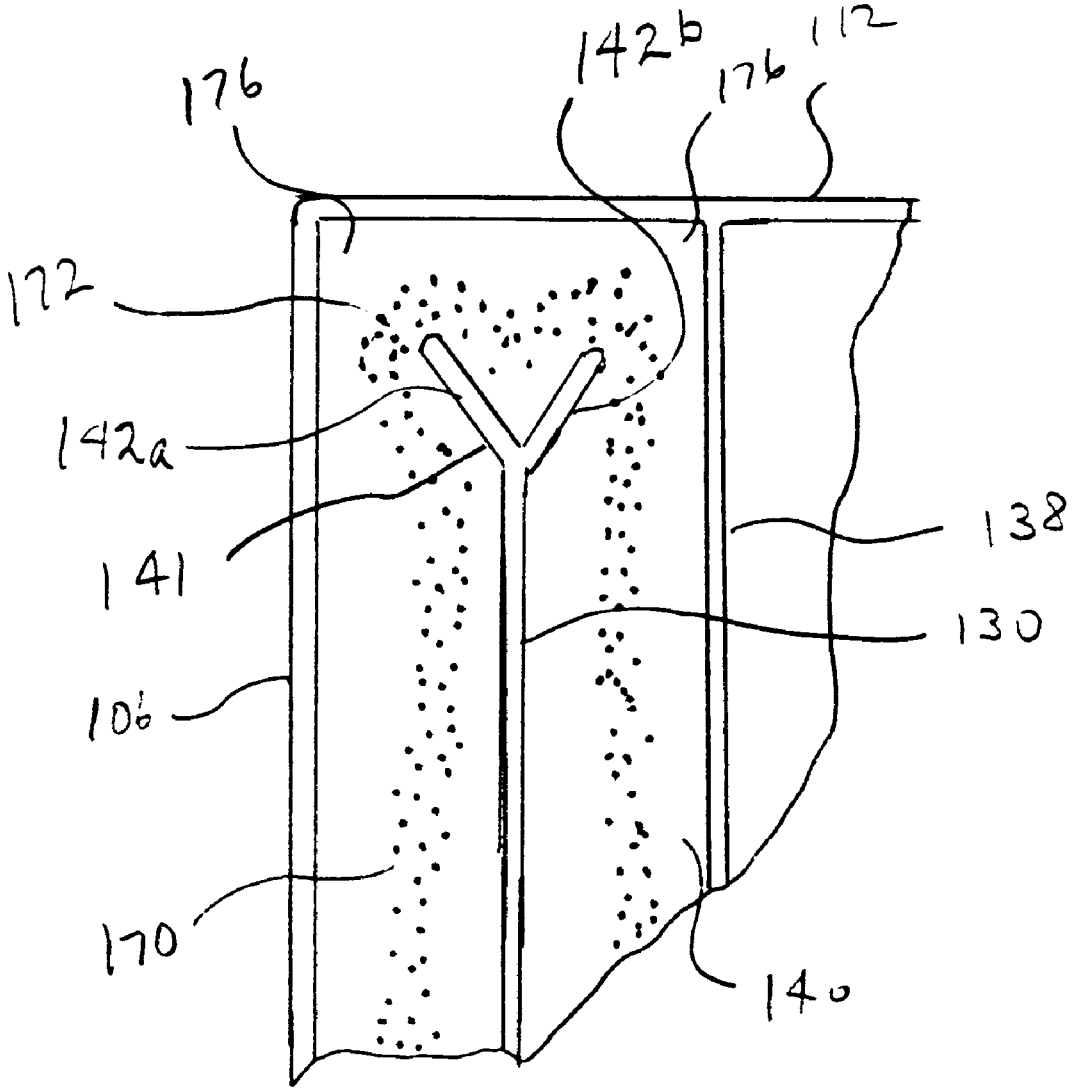
FIG. 3 is an enlarged fragmentary view of the lamp of FIG. 2.

The present invention is directed to a planar fluorescent lamp 100, shown in a first embodiment in FIGS. 2A–3, and includes a lamp body 102 of a transparent glass. The lamp body 102 is formed from a base 104 having first and second sidewalls 106 and 108 and first and second endwalls 110 and 112 projecting upwardly therefrom to form a recess. A transparent glass lamp cover 116 overlays the recess and is bonded to the sidewalls 106 and 108 and the endwalls 110 and 112 such that the lamp body 102 and lamp cover 116 together form a sealed chamber 118.

Within the chamber 118 is a channel endwall 122, which is substantially parallel to and spaced apart from the first endwall 110. The first endwall 110 includes a curved central portion 126 that intersects the channel endwall 122.

A plurality of channel walls 130 project from the channel endwall 122 toward the second endwall 112. The channel walls 130 terminate a short distance from the second endwall 112 forming gaps 134 between the distal ends of the channel walls 130 and the second endwall 112. A complementary set of channel walls 138 extend from the second endwall 112 toward the channel endwall 122 and form similar gaps 134 at their distal ends. The channel walls 130 and 138 are spaced apart at substantially equal intervals intermediate the first sidewall 106 and the second sidewall 108 to define a serpentine channel 140. The channel walls 130 and 138 are glass walls integral to the lamp body and project upwardly from the base 104 toward the lamp cover 116.

At the distal end of each of the channel walls 130 and 138 is a guide member 141. In a preferred embodiment, the guide member 141 comprises angled fins 142*a* and 142*b*. The angled fins 142*a* and 142*b* extend from the channel walls 130 and 138 into, and partially block, the serpentine channel 140. In a preferred embodiment, the gap 134 formed near the guide member 141 is approximately 65% of the width of each channel of the serpentine channel 140. As will be discussed in greater detail below, the guide member 141 is designed to guide the plasma discharge toward a central portion of the serpentine channel 140 to provide more uniform light near the gaps 134 of the serpentine channel.

The lamp 100 also includes shoulder portions 144 of the first and second sidewalls 106 and 108, which project toward the channel endwall 122. The channel endwall 122 also includes shoulder portions 146 at each end, which project toward the shoulder portions 144 of the first and second sidewalls 106 and 108. A partial circular contoured surface formed in the first and second sidewalls 106 and 108 and the first endwall 110, and a partial circular contoured surface of the shoulder 144 and the shoulder 146 define a getter space 148. Each getter space 148 is sized to retain a getter (not shown) within the plasma discharge pathway. As is well known in the art, the getter chemically interacts with and removes impurities from the gas within the chamber 118.

The first endwall 110, the channel wall 122, and the curved portion 126 of the first endwall define compartments 150. First and second electrodes 152 and 154 are cold cathode electrodes positioned within the compartments 150. Apertures 158 in the curved portion 126 of the first endwall 110 permit passage of electrical wires for external connection to the first and second cathodes 152 and 154. During assembly, conventional glass soldering techniques are used to seal the apertures 158 to provide an airtight seal.

The various sidewalls, endwalls, and channel walls are all bonded to the lamp cover 116 using known glass soldering technique. The first and second sidewalls 106 and 108 and the first and second endwalls 110 and 112 provide a seal for the chamber 118. The channel walls 130 and 138 are bonded to the lamp cover 116 by the glass solder such that the channel walls provide insulative barriers between adjacent sections of the serpentine channel 140. The glass solder between the lamp cover 116 and the channel endwall 122 provide insulative barriers between the serpentine channel 140 and the compartments 150.

The circular portion of the first endwall 110 and the circular portion of the shoulder 146 define a passageway 162 between the getter space 148 and the compartment 150. The shoulder 144 of the first and second sidewalls 106 and 108 combine with the shoulder portion 146 of the channel endwall 122 to define a passageway 164 between the serpentine channel 140 and the getter space 148.

The first and second electrodes 152 and 154, upon electrical excitation by a power supply $V_p$, produce a plasma discharge, which travels along the serpentine channel 140 between the first and second electrodes. The power supply $V_p$ typically supplies a high voltage alternating current (AC) signal. However, a direct current (DC) power supply can also be used for the power supply $V_p$. The current flow of the plasma discharge follows a pathway through the passageway 162, the getter space 148, the passageway 164, and the serpentine channel 140.

A gas within the chamber 118, which may include mercury vapor, reacts to the plasma discharge and produces ultraviolet radiation in response thereto. The ultraviolet radiation is converted to visible light energy by a fluorescent layer 164 which coats the interior of the recess, including the channel walls 130 and 136, the interior portion of the first and second sidewalls 106 and 108, and the first and second outer channel walls 141 and 142. The visible light energy $L_p$ emitted by the fluorescent layer 164 is transmitted to an observer through the transparent lamp cover 116.

Although mercury vapor is frequently used in fluorescent lamps, it is well known to use other gases, such as Argon, Xenon, a mixture of inert and halogen gases and the like, either alone or in combination to produce the desired spectral characteristics. In addition, it is known to vary the lamp pressure to alter the spectral characteristics of the lamp for a given gas. Furthermore, it is known to use photoluminescent materials other than phosphors to generate visible light in response to excitation by UV radiation. Accordingly, the present invention is not limited by the lamp pressure, the type of photoluminescent material, or type of gas used to fill the lamp 100.

Apertures 167 in the first end wall 110 are used to introduce the gas into the lamp 100. The evacuation of the chamber 118 and the introduction of the gas is accomplished in a well known fashion, which need not be described herein. Following the introduction of gas into the lamp 100, the apertures 167 are sealed using conventional glass soldering techniques.

As previously discussed, the disadvantage of the conventional lamp 10 (see FIGS. 1A and 1B) is the nonuniformity in the distribution of the electric plasma discharge in the corners 38. The angled fins 142*a* and 142*b* of the guide member 141 advantageously force the plasma discharge into the central portion of the serpentine channel 140. This is illustrated in FIG. 3, which is an enlarged fragmentary view of FIG. 2A. The plasma discharge follows a pathway illustrated in FIG. 3 with the reference numeral 170. In the region near the angled fins 142*a* and 142*b*, the plasma discharge is forced, by the angled fins, to a central area 172 of the serpentine channel 140. As a result, the plasma discharge pathway 170 is moved closer to corners 176 of the serpentine channel 140 resulting in a more uniform current density distribution of the plasma discharge throughout the serpentine channel, and thus providing more uniform lighting in the corners 176 of the serpentine channel. As a result, the lamp 100 provides more uniform lighting than is possible with the conventional lamp 10 (see FIGS. 1A and 1B).

Figure 4A:
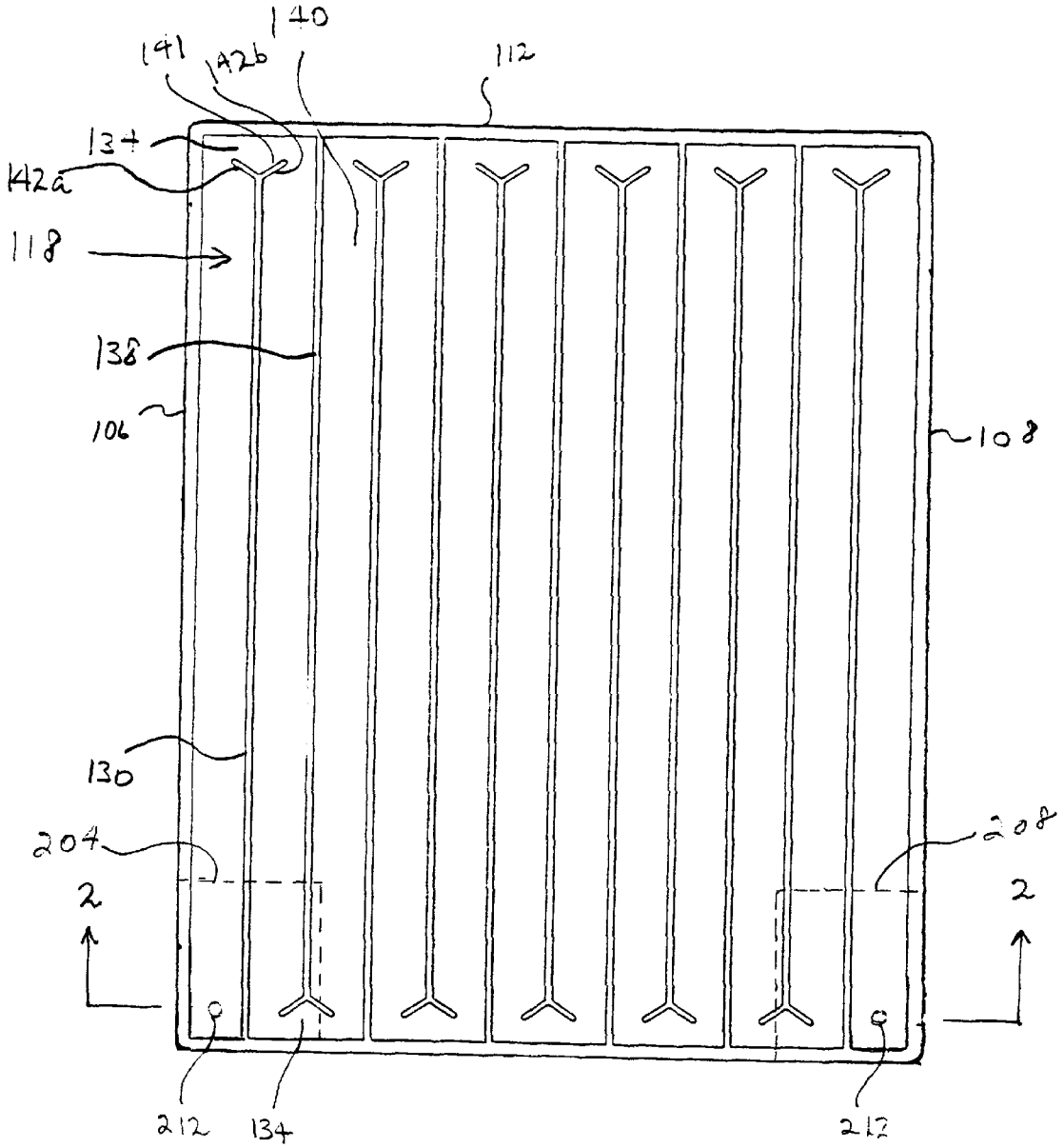
FIG. 4A is a top plan view of a lamp according to an alternative embodiment to the present invention.
Figure 4B:
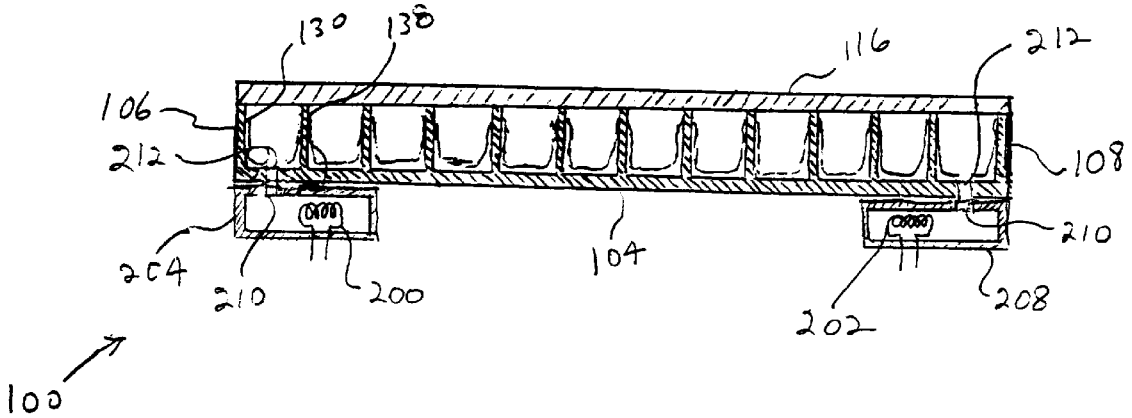
FIG. 4B is a side elevational view of the lamp of FIG. 4A taken along the line 2—2.

The embodiment of the lamp 100 illustrated in FIGS. 2A and B utilizes cold internal cathodes for the electrodes 152 and 154. However, those of ordinary skill in the art will recognize that hot cathodes, or a combination of hot and cold cathodes may be used in accordance with the principles of the present invention. The cathodes may be mounted internally, as illustrated in FIG. 2A and 2B, or mounted externally, as illustrated in FIGS. 4A and 4B. As illustrated in FIG. 4A, the channel endwall 122 (see FIG. 2A) has been removed. The channel walls 138 extend from the first endwall 110 to a region near the second endwall 112. Similarly, the channel walls 138 extend from the second endwall 112 to a predetermined distance from the first endwall 110. As with the embodiment of FIGS. 2A and 2B, the embodiment illustrated in FIGS. 4A and 4B includes the serpentine channel 140 formed by the first and second sidewalls 106 and 108, the first and second endwalls 110 and 112, and the channel walls 130 and 138.

First and second hot cathode type electrodes 200 and 202 are contained within external electrode modules 204 and 208. The first and second electrodes 200 and 202 are coupled to the power supply $V_p$ and receive electrical power therefrom. A plasma discharge is established in the serpentine channel between the first and second hot cathode type electrodes 200 and 202 in response to the application of power from the power supply $V_p$.

The electrode modules 204 and 208 are bonded, using conventional glass solder techniques, to the base 104 of the lamp 100. When the electrode modules 204 and 208 are bonded to the lamp base 104, apertures 210 in the electrode modules are in alignment with and communicate with corresponding apertures 212 in the lamp base. The apertures 210 and 212 permit the equalization of vacuum within the serpentine channel 140 and electrode modules 204 and 208. In addition, the aligned apertures 210 and 212 permit the flow of the plasma discharge between the first and second hot cathode type electrodes 200 and 202 along the serpentine channel 140. As described above with respect to the embodiment of FIGS. 2A and 2B, the guide members 141 force the electric plasma discharge toward the center 172 of the serpentine channel 140 thus providing greater uniformity of light than is possible with the conventional lamp 10 (see FIGS. 1A and 1B).

In yet another alternative embodiment, the cold cathode type internal electrodes 152 and 154 (see FIG. 2A) can be replaced by internal hot cathode type electrodes. In yet another alternative embodiment, the external hot cathode type electrodes 200 and 202 (see FIG. 4B) are replaced by external cold cathode type electrodes. The operation of the various internal and external cathodes is well known in the art, and need not be described in greater detail herein.

Figure 5:
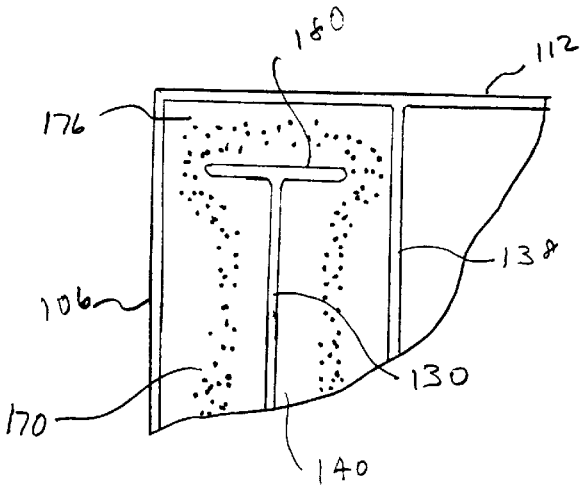
FIG. 5 is an enlarged fragmentary view of an alternative embodiment of the lamp of FIG. 2.
Figure 6:
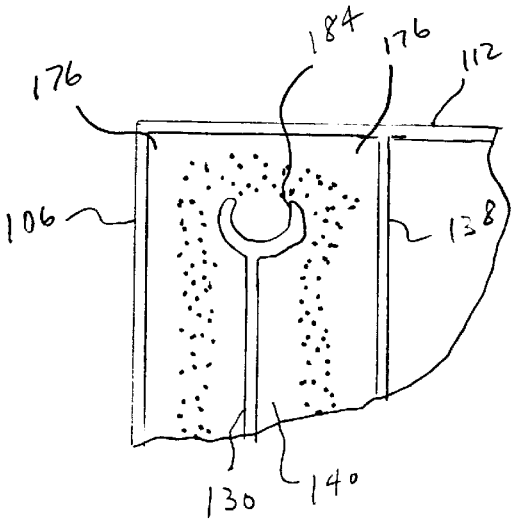
FIG. 6 is an enlarged fragmentary view of yet another alternative embodiment of the lamp of FIG. 2.

The angled fins 142*a* and 142*b* extend from the channel 130 and 138 to form a generally Y-shaped deflection surface having an obtuse angle formed between the angled fins. This shape was selected to provide the desired deflection of the plasma discharge, and yet occupy as small a volume as possible within the serpentine channel 140. However, those skilled in the art will recognize that other forms may be used for the deflection member. For example, the lamp 100 may include a generally T-shaped enlarged end portion 180, as illustrated in FIG. 5. In yet another alternative embodiment, a curved deflection member 184 may be used, as illustrated in FIG. 6.

Figure 7:
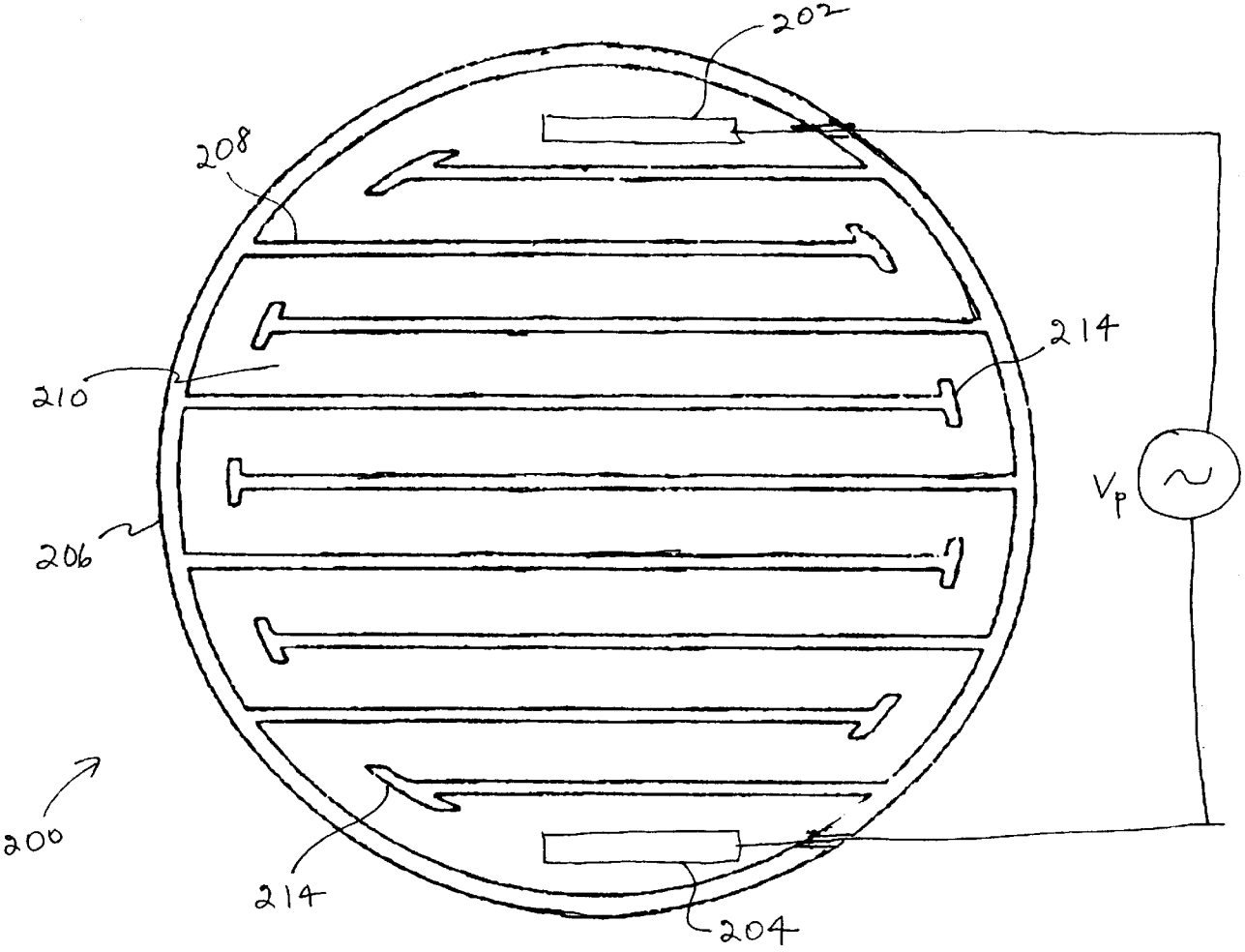
FIG. 7 is a top plan view of another lamp design constructed in accordance with the principles of the present invention.
Figure 1A:
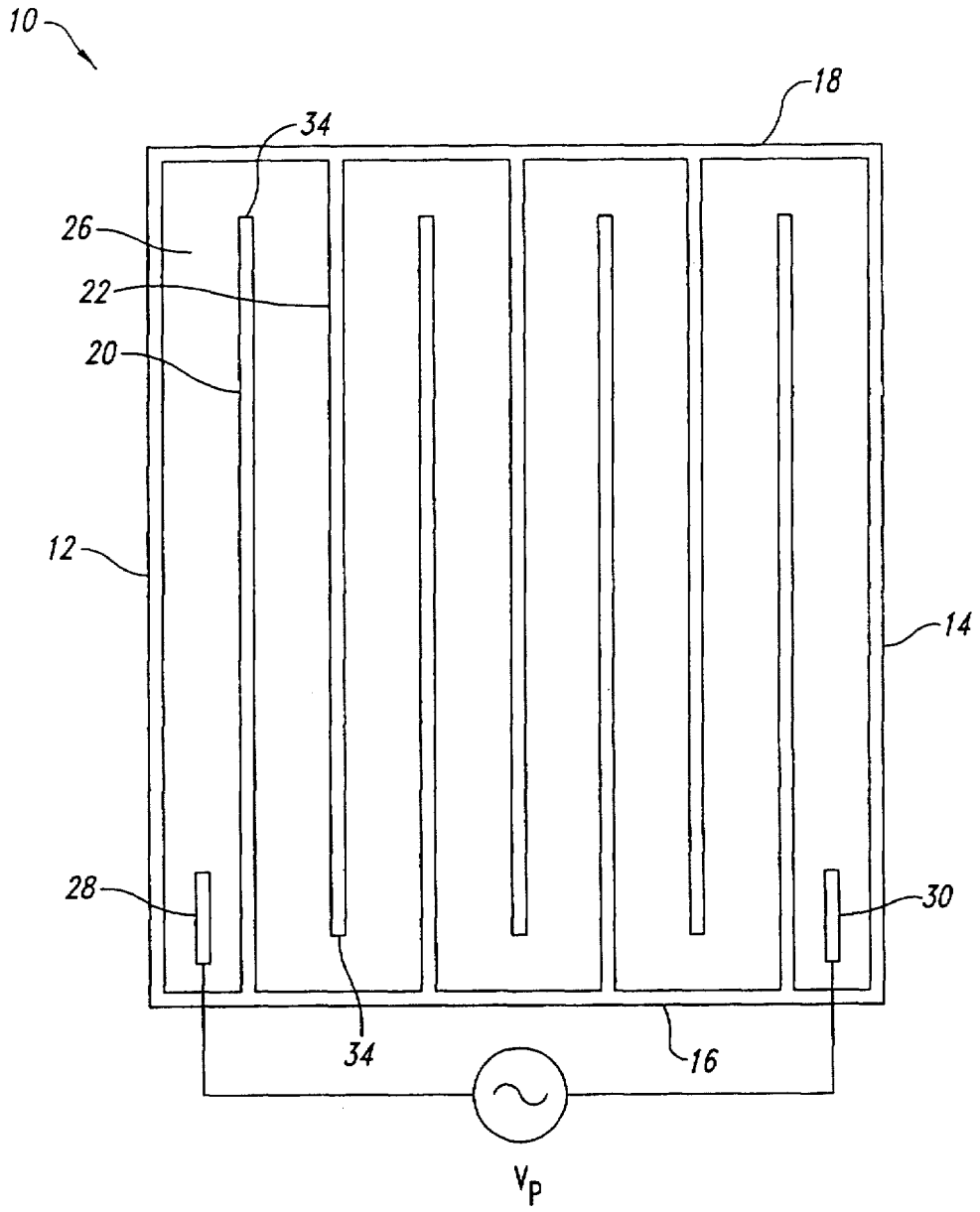
Fig. 1A (Prior Art)
Figure 1B:
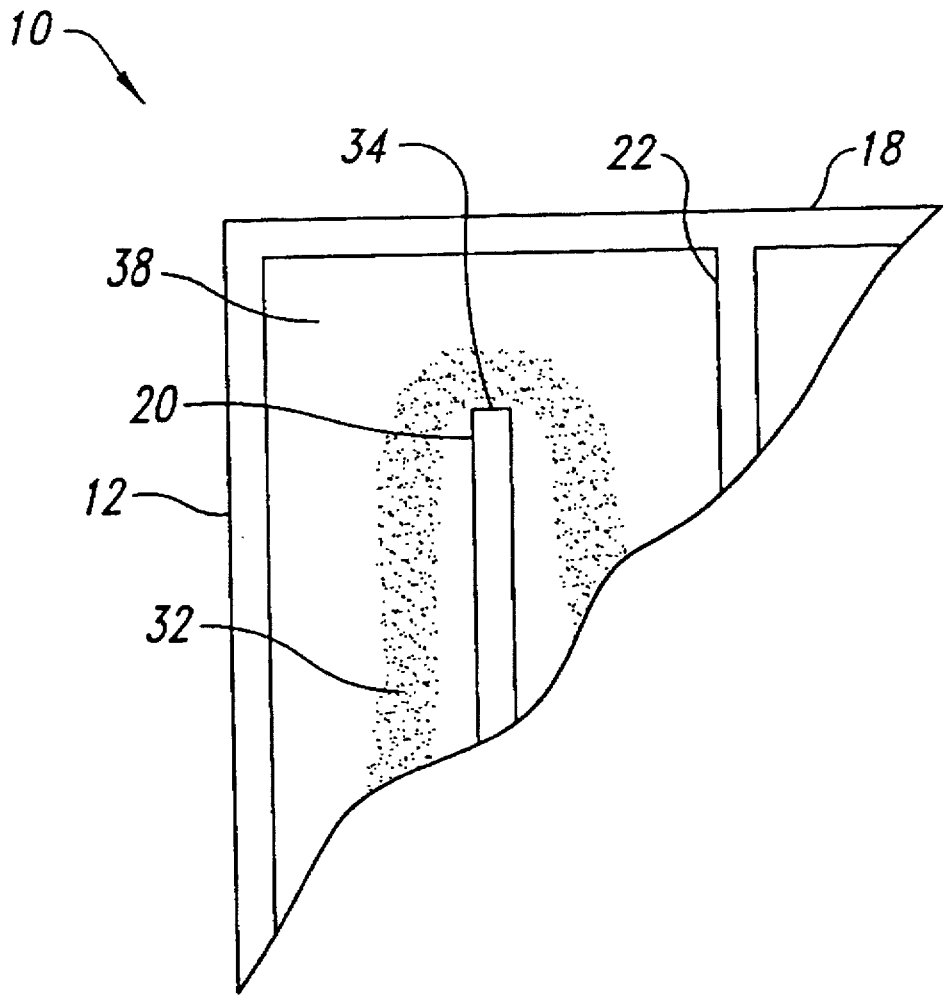
Fig. 1B (Prior Art)
Figure 2A:
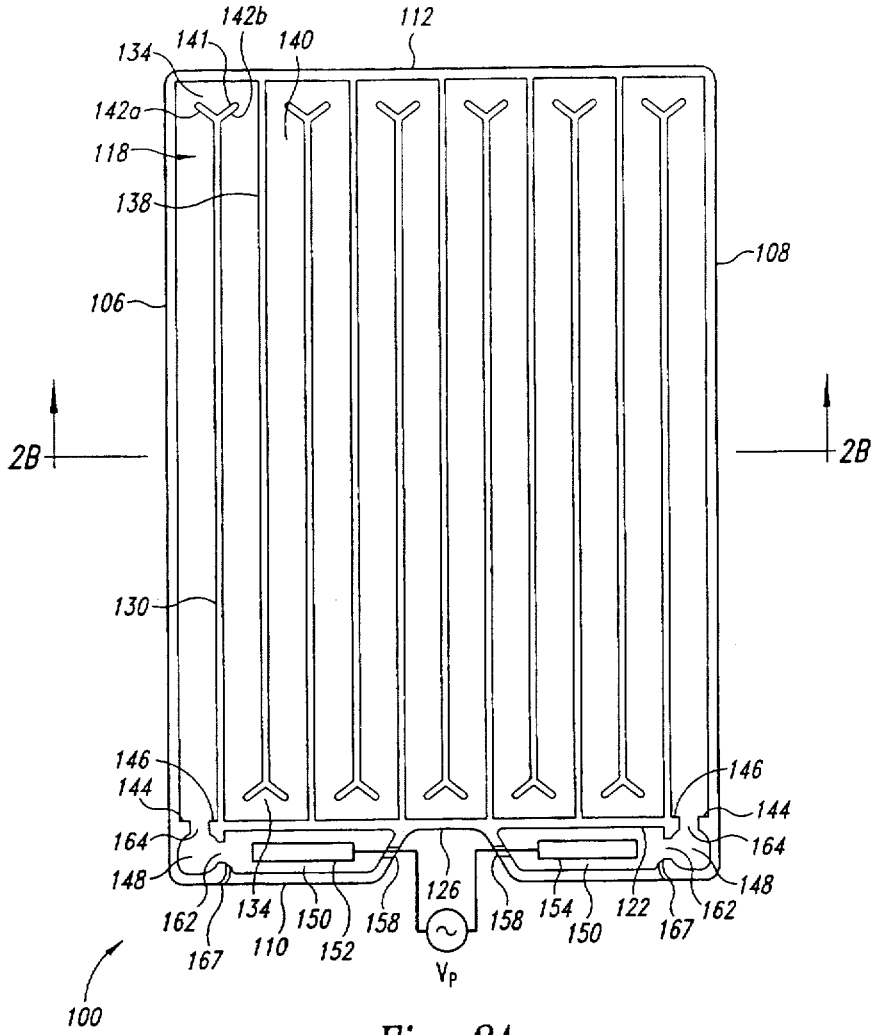
Figure 2B:
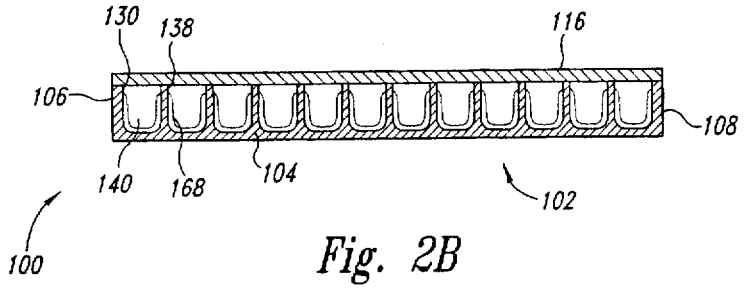
Figure 3:
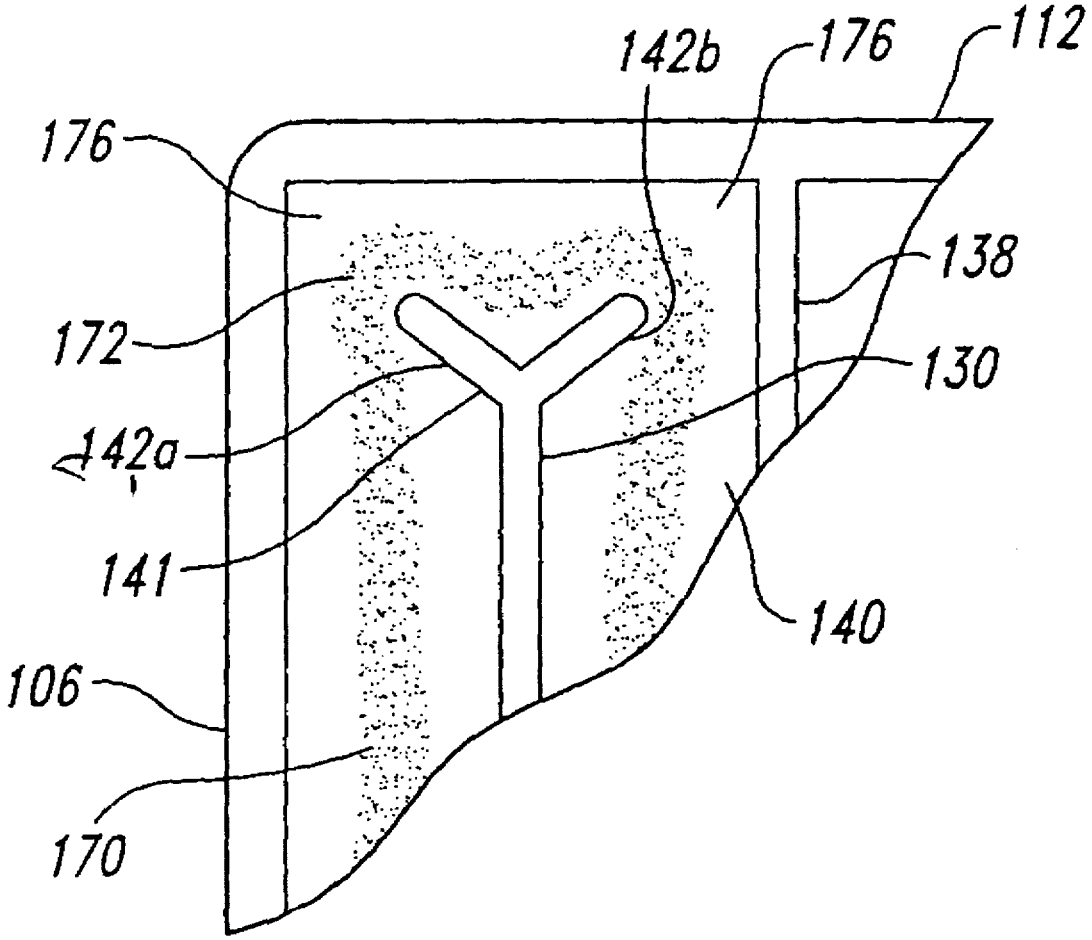
Figure 4A:
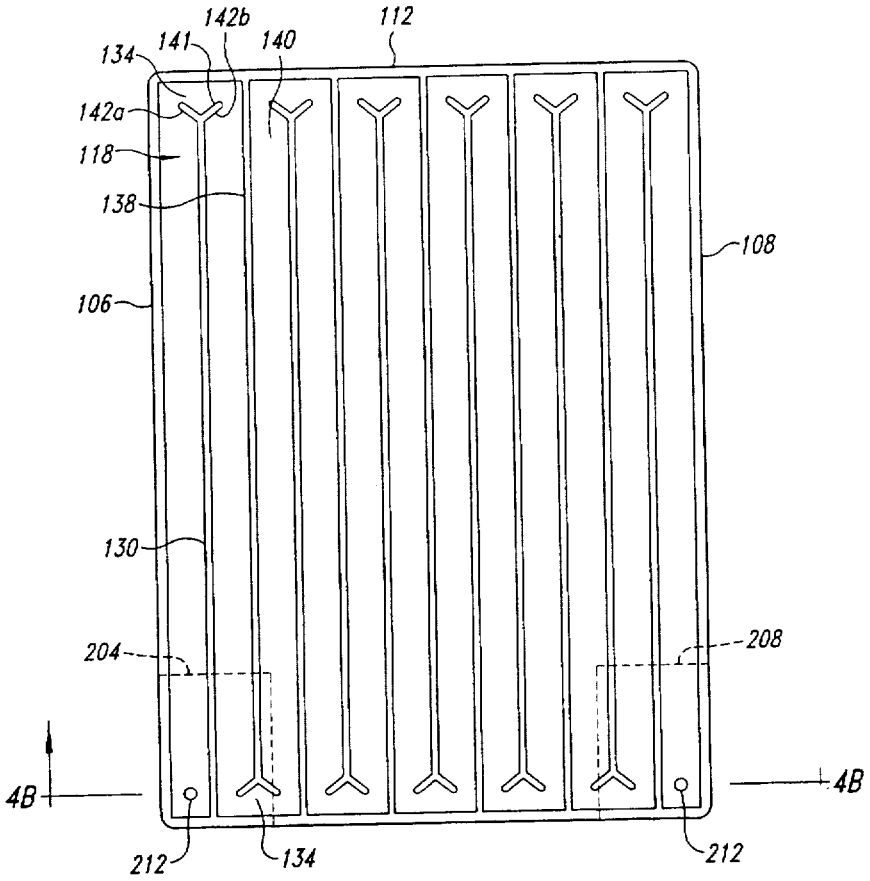
Figure 4B:
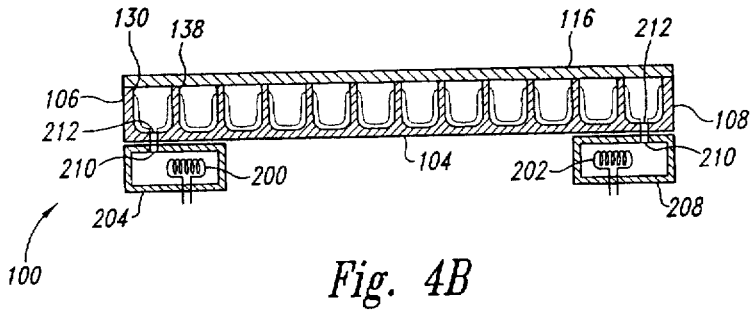
Figure 5:
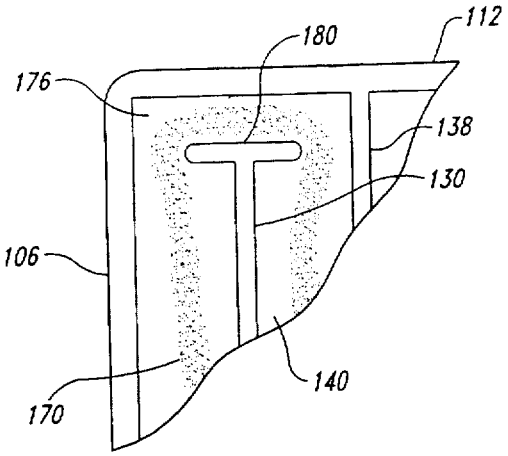
Figure 6:
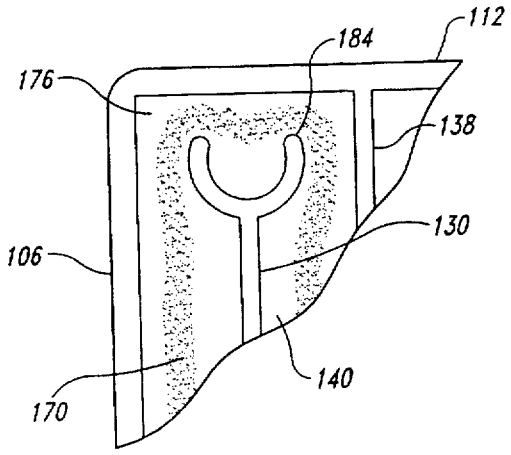
Figure 7:
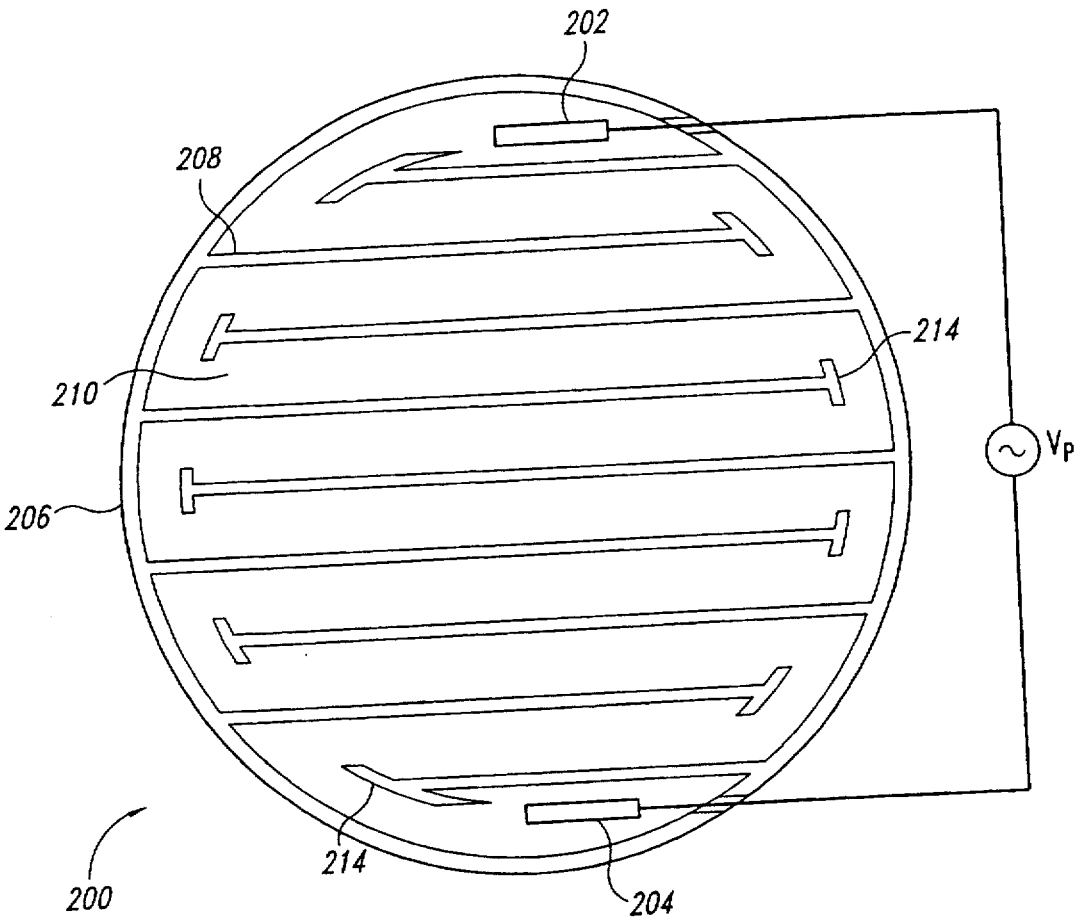

In another alternative embodiment, the principles of the present invention may be applied to a round fluorescent lamp 200, as shown in FIG. 7. First and second electrodes 202 and 204, which may be cold cathode or hot cathode type electrodes, are contained within the lamp 200. A circular wall 206 includes a plurality of internal walls 208 to define a serpentine channel 210. A first end of each internal wall 208 is coupled to the circular wall 206. A second end of each internal wall 208 terminates a short distance from the circular wall 206. A curved deflection member 214 at the terminating end of each internal wall 208 serves to guide the plasma discharge to the center of the serpentine channel 210. The shape of the curved deflection members 214 may be altered to accommodate the curvature of the curved wall 206.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A planar photoluminescent lamp, comprising:

a lamp body having first and second opposing endwalls, first and second sidewalls and a base;

a first plurality of internal channel walls extending from the first endwall and having an enlarged end portion that terminates a predetermined distance from the second endwall;

a second plurality of internal channel walls extending from the second endwall and having an enlarged end portion that terminates a predetermined distance from the first endwall, the first and second plurality of internal channel walls defining a serpentine channel having a channel length extending from a first end to a second end;

a lamp cover mounted to the lamp body such that the lamp body and the lamp cover seal the serpentine channel and thereby define a chamber;

a first set of electrodes in proximity with the first and second ends, respectively, to produce a plasma discharge between the a first of the first set of electrodes and a second of the first set of electrodes along the channel length when supplied with electrical power;

a gas within the chamber to emit ultraviolet energy in response to the plasma discharge, the gas emitting a quantity of ultraviolet energy in response to the plasma discharge along the channel length; and a photoluminescent material within the chamber to produce visible light in response to the ultraviolet energy.

2. The lamp of claim 1 wherein the enlarged end portions of the first and second plurality of internal channel walls each includes first and second angled fins extending from the internal channel.

3. The lamp of claim 2 wherein the first and second angled fins form an obtuse angle with respect to each other.

4. The lamp of claim 1 wherein the enlarged end portions of the first and second plurality of internal channel walls includes a curved deflection member.

5. The lamp of claim 1 wherein the first and second electrodes are a cold cathode type.

6. The lamp of claim 1 wherein the first and second electrodes are a hot cathode type.

7. The lamp of claim 1 wherein the first and second electrodes are internal type cathodes mounted within the lamp body.

8. The lamp of claim 1 wherein the first and second electrodes are external type cathodes mounted outside the lamp body.

9. The lamp of claim 1 wherein the enlarged end portions of the first plurality of internal channel walls include a deflection surface extending from the first plurality of internal channel walls and facing the first of the plurality of sidewalls.

10. The lamp of claim 9 wherein the enlarged end portions of the second plurality of internal channel walls include a deflection surface extending from the second plurality of internal channel walls and facing the second of the plurality of sidewalls.

11. A gas-filled photoluminescent lamp containing a photoluminescent material to emit visible light when the gas emits ultraviolet energy in response to a plasma discharge, the lamp comprising:

a lamp body having first and second interconnected passageways coupled together at a junction to form a channel with a channel length extending from a first end to a second end;

a first electrode associated with the lamp body in proximity with the first channel end;

a second electrode associated with the lamp body in proximity with the second channel end, said first and second electrodes configured to produce the plasma discharge therebetween along the channel length when supplied with electrical power; and a guide member in proximity with the junction and extending into the channel to partially block the channel and thereby guide the plasma discharge to a central portion of the channel.

12. The lamp of claim 11 wherein the guide member includes first and second angled fins extending from the junction into the channel.

13. The lamp of claim 11 wherein the guide member includes a curved deflection member.

14. The lamp of claim 11 wherein the first and second electrodes are a cold cathode type.

15. The lamp of claim 11 wherein the first and second electrodes are a hot cathode type.

16. The lamp of claim 11 wherein the first and second electrodes are internal type cathodes mounted within the lamp body.

17. The lamp of claim 11 wherein the first and second electrodes are external type cathodes mounted outside the lamp body.

18. The lamp of claim 11 wherein the lamp housing includes first and second opposing endwalls, the lamp further including a first internal wall extending from the first endwall and terminating a predetermined distance from the second endwall and a second internal channel wall extending from the second endwall and terminating a predetermined distance from the first endwall, the lamp having a plurality of junctions formed at the terminating ends of the first and second internal channel walls and including a guide member associated with each of the plurality of junctions.

* * * * *

UNITED STATES PATENT AND TRADEMARK OFFICE

CERTIFICATE OF CORRECTION

PATENT NO. : 5,903,096
DATED : May 11, 1999
INVENTOR(S) : Winsor

It is certified that error appears in the above-identified patent and that said Letters Patent is hereby corrected as shown below:

On the title page, item [54] should read -- PHOTOLUMINESCENT LAMP WITH ANGLED FINS ON INTERNAL CHANNELS WALLS --

Signed and Sealed this

Seventh Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,903,096
DATED : May 11, 1999
INVENTOR(S) : Winsor

It is certified that error appears in the above-identified patent and that said Letters Patent is hereby corrected as shown below:

Title page,
Title page, should be deleted to be replaced with the attached title page.

Drawing sheets consisting of Figs. 1A thru 7, should be replaced with the drawing sheets, consisting of Figs. 1A thru 7, as shown on the attached pages.

Signed and Sealed this

Twenty-fifth Day of December, 2001

*Attest:*

*Attesting Officer*

JAMES E. ROGAN
*Director of the United States Patent and Trademark Office*

United States Patent [19]

Winsor

[11] Patent Number: 5,903,096

[45] Date of Patent: May 11, 1999

[54] PHOTOLUMINESCENT LAMP WITH ANGLED PINS ON INTERNAL CHANNEL WALLS

[75] Inventor: Mark D. Winsor, Seattle, Wash.

[73] Assignee: Winsor Corporation, Olympia, Wash.

[21] Appl. No.: 08/940,609

[22] Filed: Sep. 30, 1997

[51] Int. Cl.[6] ..... H01J 1/62

[52] U.S. Cl. ..... 313/493; 313/609; 313/610; 313/634

[58] Field of Search ..... 313/493, 609, 313/610, 611, 634, 483

[56] References Cited

U.S. PATENT DOCUMENTS

| | | | |
|---|---|---|---|
| 1,984,215 | 12/1934 | Hotchner | 176/14 |
| 2,255,431 | 9/1941 | Marden et al. | 176/122 |
| 2,405,518 | 8/1946 | Polevitzky | 176/122 |
| 2,555,749 | 6/1951 | Kreffit | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,103,607 | 9/1963 | Rulon | 313/108 |
| 3,121,184 | 2/1964 | Fox | 313/207 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,313,652 | 4/1967 | Blazek et al. | 117/215 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,117,374 | 9/1978 | Witting | 315/99 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |
| 4,482,580 | 11/1984 | Emmett et al. | 427/66 |
| 4,698,547 | 10/1987 | Grossman et al. | 313/485 |

FOREIGN PATENT DOCUMENTS

| | | | |
|---|---|---|---|
| 0 066 495 A2 | 12/1982 | European Pat. Off. | H01J 61/32 |
| 0 329 226 A1 | 8/1989 | European Pat. Off. | H01J 65/04 |
| 0 550 047 A2 | 7/1993 | European Pat. Off. | H01J 61/70 |
| 89 04 853 U | 8/1989 | Germany | H01J 61/67 |
| 39 22 865 A1 | 1/1991 | Germany | H01J 65/04 |
| 43 13 017 A1 | 12/1994 | Germany | H01J 61/70 |
| 60-216435 | 10/1985 | Japan . | |
| 62-208536 | 9/1987 | Japan . | |
| 1017374 | 1/1989 | Japan . | |
| 64-17374 | 1/1989 | Japan | H01J 61/30 |
| 1206553 | 8/1989 | Japan . | |
| 2-72552 | 3/1990 | Japan | H01J 61/30 |
| 2-78147 | 3/1990 | Japan | H01J 61/30 |
| 3-46748 | 2/1991 | Japan | H01J 61/94 |
| 3-129659 | 6/1991 | Japan | H01J 61/35 |
| 3-222253 | 10/1991 | Japan | H01J 61/92 |
| 3-285249 | 12/1991 | Japan | H01J 61/32 |
| 4-95337 | 3/1992 | Japan | H01J 61/67 |
| 4-147554 | 5/1992 | Japan | H01J 61/30 |
| 2 032 681 | 5/1980 | United Kingdom . | |
| 2 217 515 | 10/1989 | United Kingdom | H01J 61/30 |
| WO 87/04562 | 7/1987 | WIPO . | |
| WO 92/02947 | 2/1992 | WIPO | H01J 61/30 |

OTHER PUBLICATIONS

Mercer et al., "Fluorescent backlights for LCDs," *Information Display:* 8–13, Nov. 1989.

Hinotani et al., "Flat Fluorescent Lamp for LCD Back-Light," 1988 *International Display Research Conference.*

*Primary Examiner*—Vip Patel

*Attorney, Agent, or Firm*—Seed and Berry LLP

[57] ABSTRACT

A planar photoluminescent lamp having a plurality of internal walls to form a serpentine channel includes a deflection member at a distal end at least portion of the internal walls to force a plasma discharge into a central portion of the channel to thereby provide more uniform lighting at junctions between the turns in the serpentine channel. As a result, the photoluminescent lamp has more uniform brightness. The principles of the present invention may be extend to any photoluminescent lamp having a junction between two channels wherein a guide member serves to guide the plasma discharge toward the center of the channel at the junction.

(List continued on next page.)

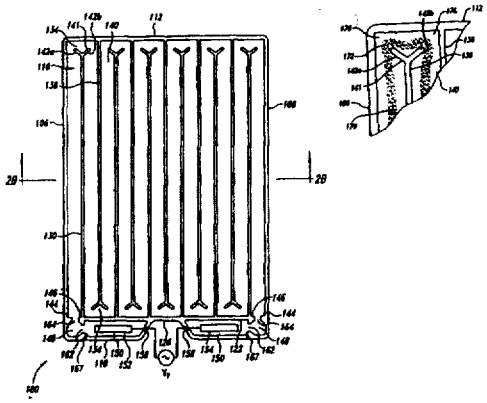

18 Claims, 9 Drawing Sheets